US011211044B2

(12) United States Patent
Zastoupil

(10) Patent No.: US 11,211,044 B2
(45) Date of Patent: Dec. 28, 2021

(54) ADJUSTABLE WAVEGUIDE

(71) Applicant: Bose Corporation, Framingham, MA (US)

(72) Inventor: Greg Joseph Zastoupil, North Grafton, MA (US)

(73) Assignee: Bose Corporation, Framingham, MA (US)

( * ) Notice: Subject to any disclaimer, the term of this patent is extended or adjusted under 35 U.S.C. 154(b) by 229 days.

(21) Appl. No.: 16/697,521

(22) Filed: Nov. 27, 2019

(65) Prior Publication Data

US 2021/0158794 A1 May 27, 2021

(51) Int. Cl.

| | |
|---|---|
| ***H04R 1/30*** | (2006.01) |
| ***G10K 11/35*** | (2006.01) |
| ***H04R 1/28*** | (2006.01) |
| ***H04R 1/40*** | (2006.01) |
| ***H04R 1/34*** | (2006.01) |

(52) U.S. Cl.

CPC ..... *G10K 11/357* (2013.01); *H04R 1/2811* (2013.01); *H04R 1/30* (2013.01); *H04R 1/345* (2013.01); *H04R 1/403* (2013.01); *H04R 2201/029* (2013.01); *H04R 2205/022* (2013.01); *H04R 2400/11* (2013.01); *H04R 2400/13* (2013.01)

(58) Field of Classification Search

CPC ..... H04R 1/24; H04R 1/2811; H04R 1/2857; H04R 1/30; H04R 1/345; H04R 1/403; H04R 29/001; H04R 29/002; H04R 2201/025; H04R 2201/029; H04R 2205/022; H04R 2400/11; H04R 2400/13; G10K 11/357

See application file for complete search history.

(56) References Cited

U.S. PATENT DOCUMENTS

| | | | | |
|---|---|---|---|---|
| 5,004,067 A * | 4/1991 | Patronis | H04R 1/30 181/188 |
| 8,607,922 B1 * | 12/2013 | Werner | H04R 1/26 181/182 |
| 10,701,477 B2 * | 6/2020 | Enenkl | H04R 1/02 |
| 2014/0353074 A1 * | 12/2014 | Bridge | H04R 1/026 181/145 |

FOREIGN PATENT DOCUMENTS

DE 10230409 B8 7/2007

OTHER PUBLICATIONS

L-Acoustics K2 user manual, accessed on Nov. 27, 2019, via https://www.l-acoustics.com/en/product/k2/.

(Continued)

*Primary Examiner* — Huyen D Le

(74) *Attorney, Agent, or Firm* — Hoffman Warnick LLC

(57) ABSTRACT

Various implementations include loudspeakers and related waveguides. The loudspeakers can include an adjustable waveguide for modifying the coverage pattern of the audio output. In some particular aspects, a loudspeaker includes: a single speaker box with at least one driver; a waveguide having: a pair of opposing walls that are fixed with respect to the at least one driver; and at least one adjustable wall that is adjustable relative to the at least one driver; and at least one fin coupled to the waveguide for accommodating a gap between the pair of opposing walls and the at least one adjustable wall.

20 Claims, 8 Drawing Sheets

(56) References Cited

OTHER PUBLICATIONS

Outline miniCOM.P.A.S.S. brochure, accessed on Nov. 27, 2019, via https://outline.it/outline-products/legacy-products/loudspeakers/compass/minicompass/.
PK Sound, Trinity user manual, accessed on Nov. 27, 2019, via https://www.pksound.ca/trinity.

* cited by examiner

ADJUSTABLE WAVEGUIDE

TECHNICAL FIELD

This disclosure generally relates to loudspeakers. More particularly, the disclosure relates to a loudspeaker having an adjustable waveguide for controlling audio output coverage patterns.

BACKGROUND

There is an increasing demand for high performance, dynamic portable loudspeakers. In particular applications such as touring, or in rental loudspeaker applications, loudspeakers must be portable and adaptable for different venues and uses. While waveguides can be used to adjust the coverage pattern from loudspeakers according to particular circumstances, carrying many sets of waveguides can be logistically challenging and result in time-consuming setup and breakdown of loudspeaker configurations. Additionally, previously developed adjustable loudspeakers have proven cumbersome for users due to highly complex moving parts.

SUMMARY

All examples and features mentioned below can be combined in any technically possible way.

Various implementations include loudspeakers and related waveguides. The loudspeakers can include an adjustable waveguide for modifying the coverage pattern of the audio output.

In some particular aspects, a loudspeaker includes: a single speaker box with at least one driver; a waveguide having: a pair of opposing walls that are fixed with respect to the at least one driver; and at least one adjustable wall that is adjustable relative to the at least one driver; and at least one fin coupled to the waveguide for accommodating a gap between the pair of opposing walls and the at least one adjustable wall.

Implementations may include one of the following features, or any combination thereof.

In some cases, the at least one adjustable wall includes a pair of adjustable walls aligned opposing one another.

In certain aspects, the pair of adjustable walls is either aligned with the pair of opposing walls or orthogonal to the pair of opposing walls.

In particular cases, the at least one adjustable wall includes a plurality of adjustable walls linked to move in unison.

In some implementations, adjusting the at least one wall modifies a coverage pattern from the loudspeaker.

In certain aspects, the at least one adjustable wall is connected with the speaker box at a primary hinge and is adjustable by pivoting about the primary hinge.

In particular cases, the at least one adjustable wall includes a secondary hinge separating a primary segment that is positioned to pivot about the primary hinge, and a secondary segment that is positioned to pivot about the secondary hinge. In some implementations, the secondary hinge can include a plurality of secondary (or, additional) hinges.

In certain implementations, the loudspeaker further includes a housing including a pocket for receiving the at least one adjustable wall when the secondary segment is folded back over the primary segment about the secondary hinge.

In some aspects, the secondary segment mitigates acoustic energy spillover into a volume behind the at least one adjustable wall.

In particular cases, the at least one fin spans between one of the pair of opposing walls and the at least one adjustable wall.

In certain aspects, the speaker box includes at least one mating feature for retaining the at least one fin in position to accommodate the gap between the pair of opposing walls and the at least one adjustable wall.

In some implementations, the at least one driver includes a line array of compression drivers or a point source.

In particular cases, the loudspeaker further includes: a sensor located on the waveguide or each fin, the sensor configured to detect a relative position of the waveguide with respect each fin; and a controller coupled with the sensor and the at least one driver, where the controller is configured to adjust an acoustic parameter of the loudspeaker in response to a detected change in the relative position of the waveguide with respect to the fin.

In certain aspects, the loudspeaker further includes a set of retaining members for selectively fixing the at least one adjustable wall to the pair of opposing walls in a first position, and selectively fixing the at least one fin to the at least one adjustable wall in a second position, where in the second position, the at least one fin substantially fills the gap between the pair of opposing walls and the at least one adjustable wall.

In some cases, the acoustic parameter includes an equalization setting of the loudspeaker.

In particular implementations, the waveguide further includes a set of drivers located on the at least one adjustable wall.

In certain aspects, the at least one adjustable wall includes a pair of opposing adjustable walls, and the set of drivers includes a first set of drivers closer to a throat of the loudspeaker than a second set of drivers.

In some implementations, the pair of opposing adjustable walls define a fixed volume behind each of the set of drivers, and the first set of drivers are tuned to a higher frequency than the second set of drivers.

In particular cases, in a first operating mode the first set of drivers is driven, and in a second operating mode the second set of drivers is driven, where in the first operating mode the pair of opposing adjustable walls are positioned at a first angle with respect to the at least one driver, and in the second operating mode the pair of opposing adjustable walls are positioned at a second, narrower angle with respect to the at least one driver.

In certain aspects, the loudspeaker further includes a motor coupled with the at least one adjustable wall for adjusting a position of the at least one adjustable wall.

In particular cases, the loudspeaker further includes a user interface coupled with the controller for indicating a position of the at least one adjustable wall and/or the at least one fin. In certain cases, the controller is configured to indicate a desired position of the at least one adjustable wall and/or the at least one fin for a given coverage pattern of the loudspeaker.

In some implementations, the at least one fin includes a plurality of fins, each fin of the plurality corresponding to a different angular position of the adjustable wall relative to the at least one driver, where each of the fins of the plurality of fins has a different height for accommodating a different gap depending on the angular orientation of the wall relative to the at least one driver.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
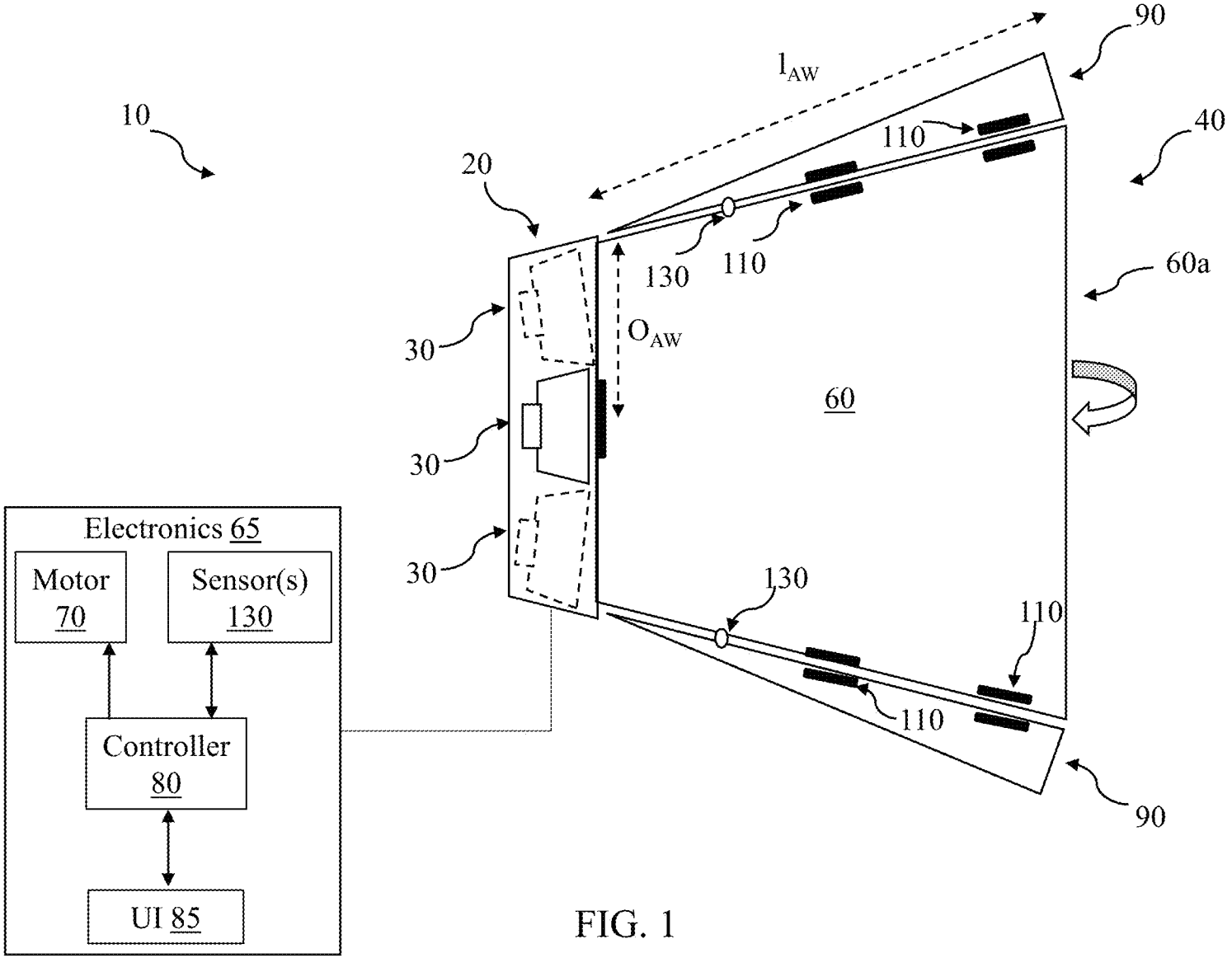
FIG. 1 shows a side perspective view of a loudspeaker according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that an adjustable waveguide can be beneficially incorporated into a loudspeaker to control the loudspeaker's coverage pattern. For example, a loudspeaker having an adjustable waveguide can provide multiple desired coverage patterns in certain applications, such as in portable speaker, touring speaker and/or rental speaker applications.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value+/−a margin of error, such as a measurement error, which may range from up to 1-5 percent.

As described herein, conventional approaches to develop high performance, dynamic portable loudspeakers have failed due to, among other things, the complexity of the speaker parts, high costs, and diminished performance. In contrast to conventional systems, the loudspeakers disclosed according to various implementations have a waveguide coupled to the loudspeaker box that includes at least one adjustable wall for modifying the loudspeaker's coverage pattern. The loudspeakers also include at least one fin coupled to the waveguide for accommodating a gap between the adjustable wall(s) and fixed walls in the waveguide. The fin aids in acoustically sealing the waveguide and the adjacent wall, minimizing leakage that can cause cavity resonances. These implementations provide loudspeakers with improved adaptability and fewer replacement and/or supplemental parts than conventional loudspeakers.

Figure 2:
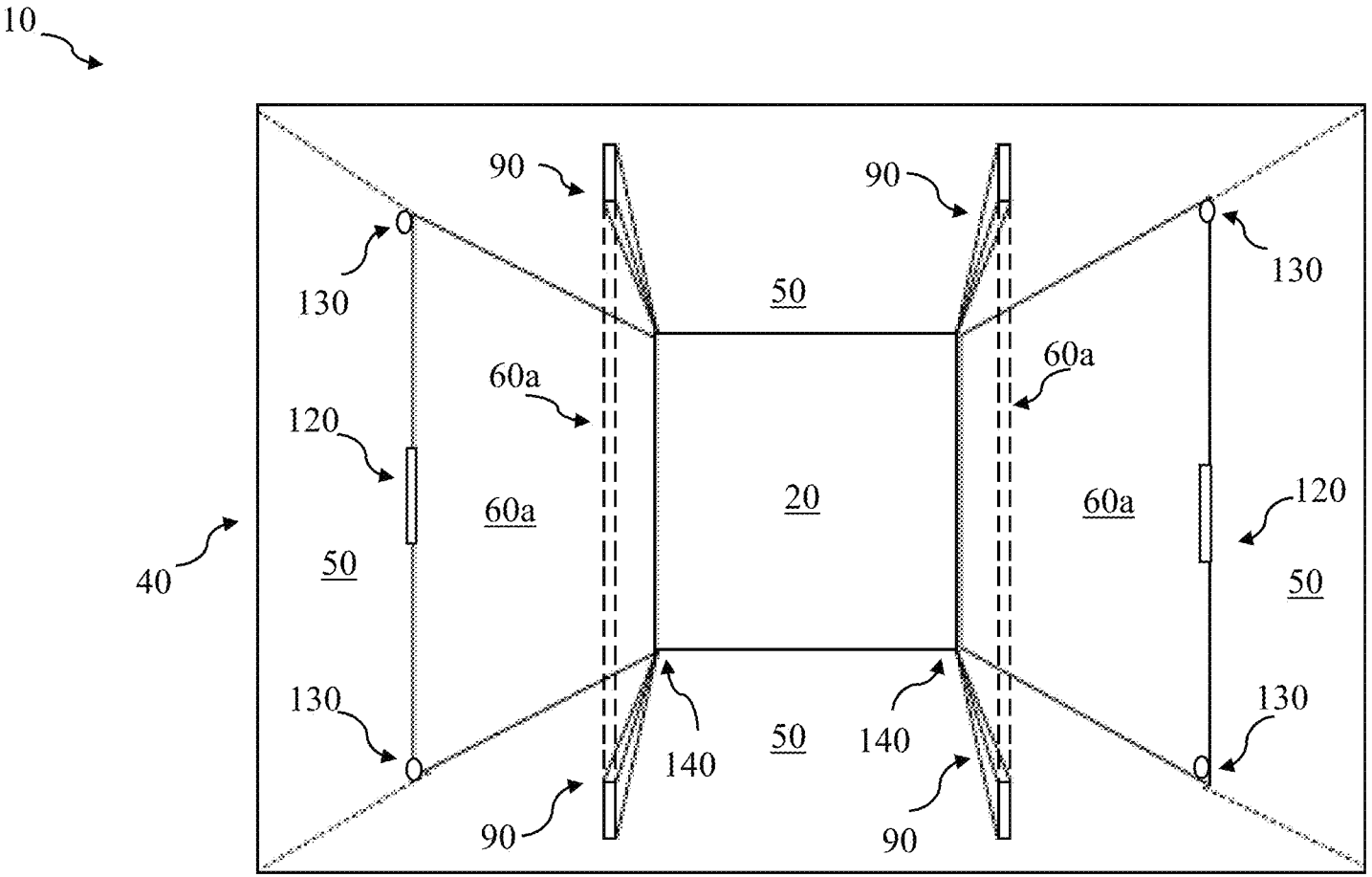
FIG. 2 shows a front view the loudspeaker of FIG. 1 in a first position.
Figure 3:
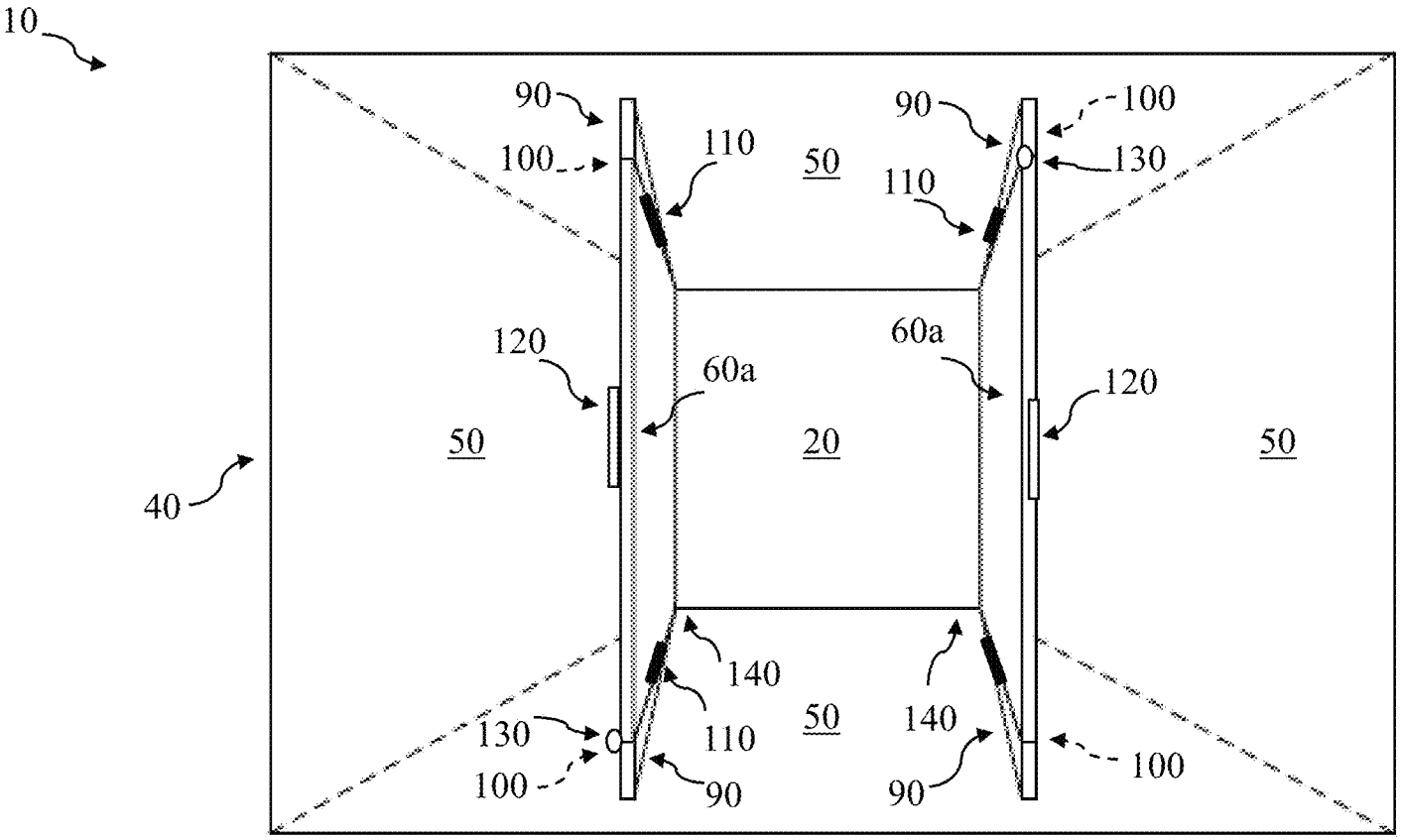
FIG. 3 shows a front view of the loudspeaker in FIGS. 1 and 2 in a second position.
Figure 4:
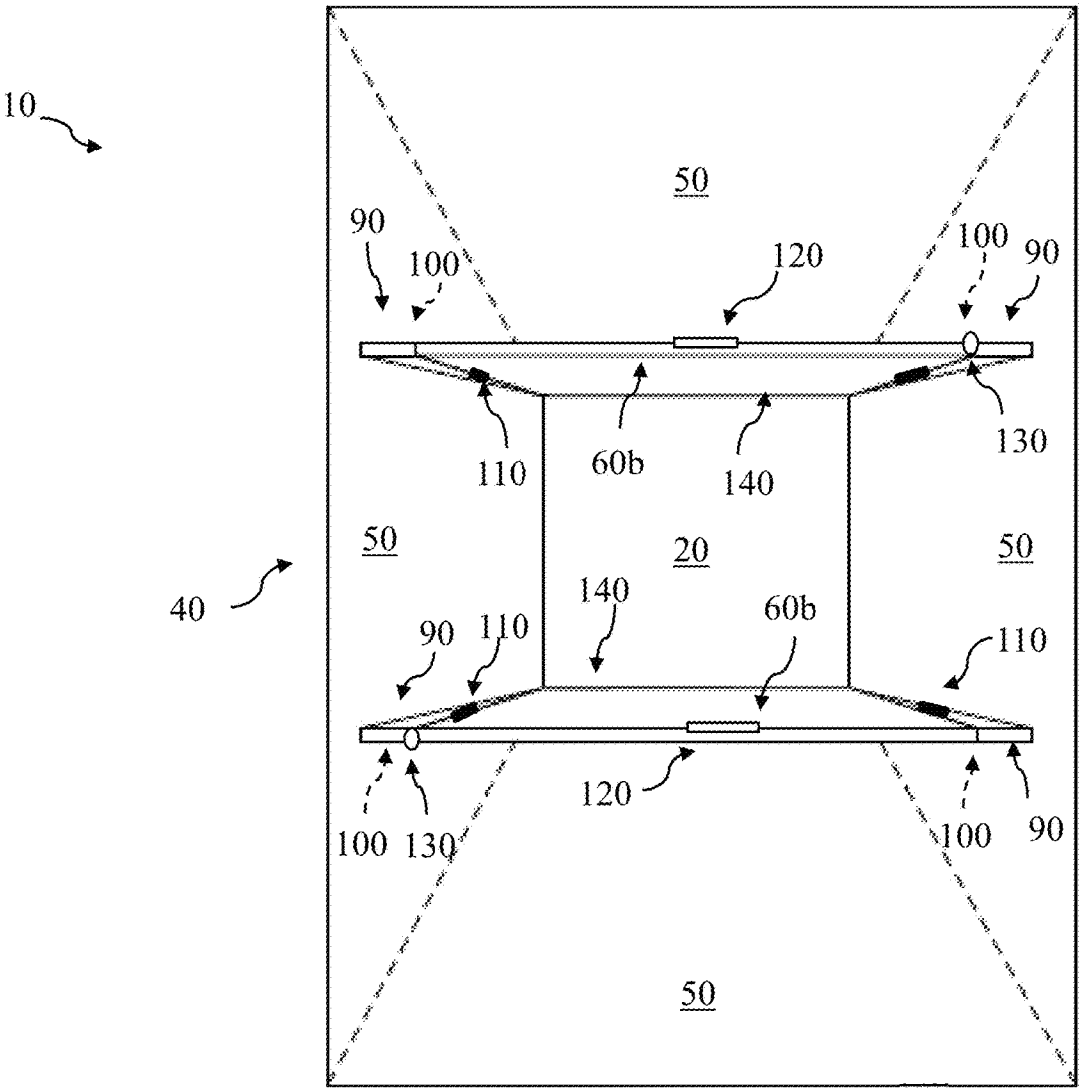
FIG. 4 shows a front view of an additional variation on a loudspeaker according to implementations.
Figure 5:
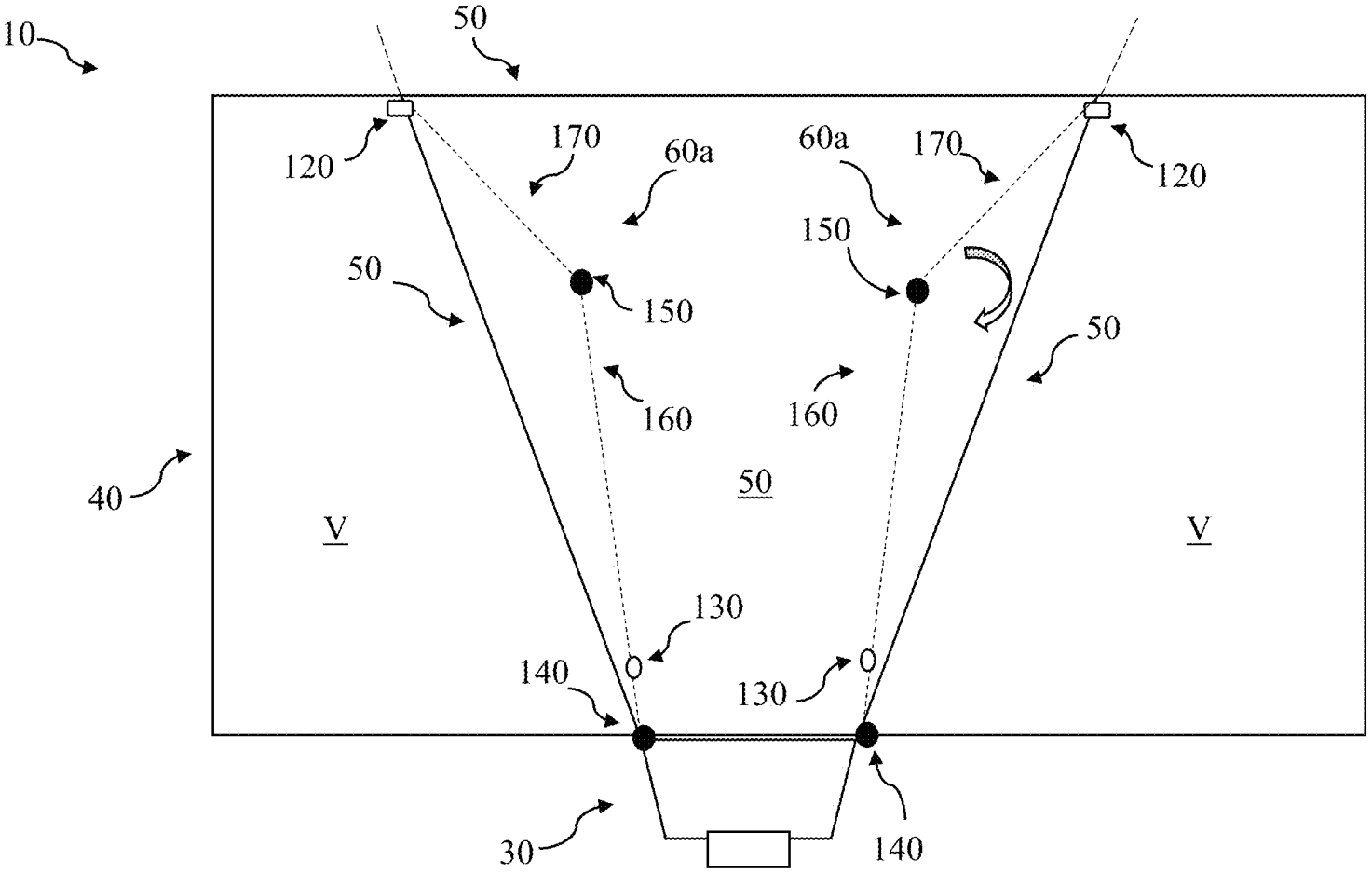
FIG. 5 shows a top view of another loudspeaker according to various implementations.
Figure 6:
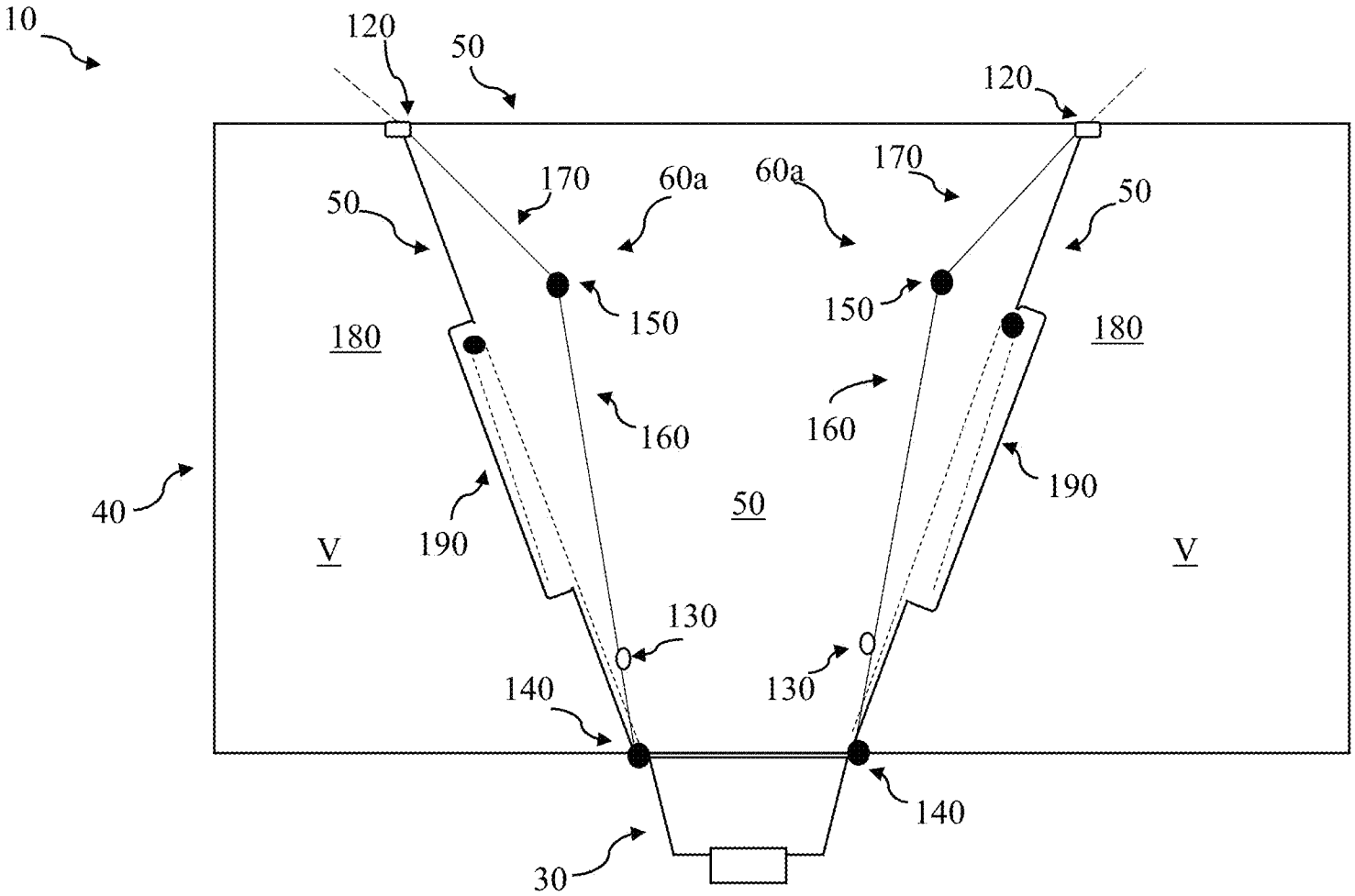
FIG. 6 shows a top view of an additional loudspeaker according to various implementations.
Figure 7:
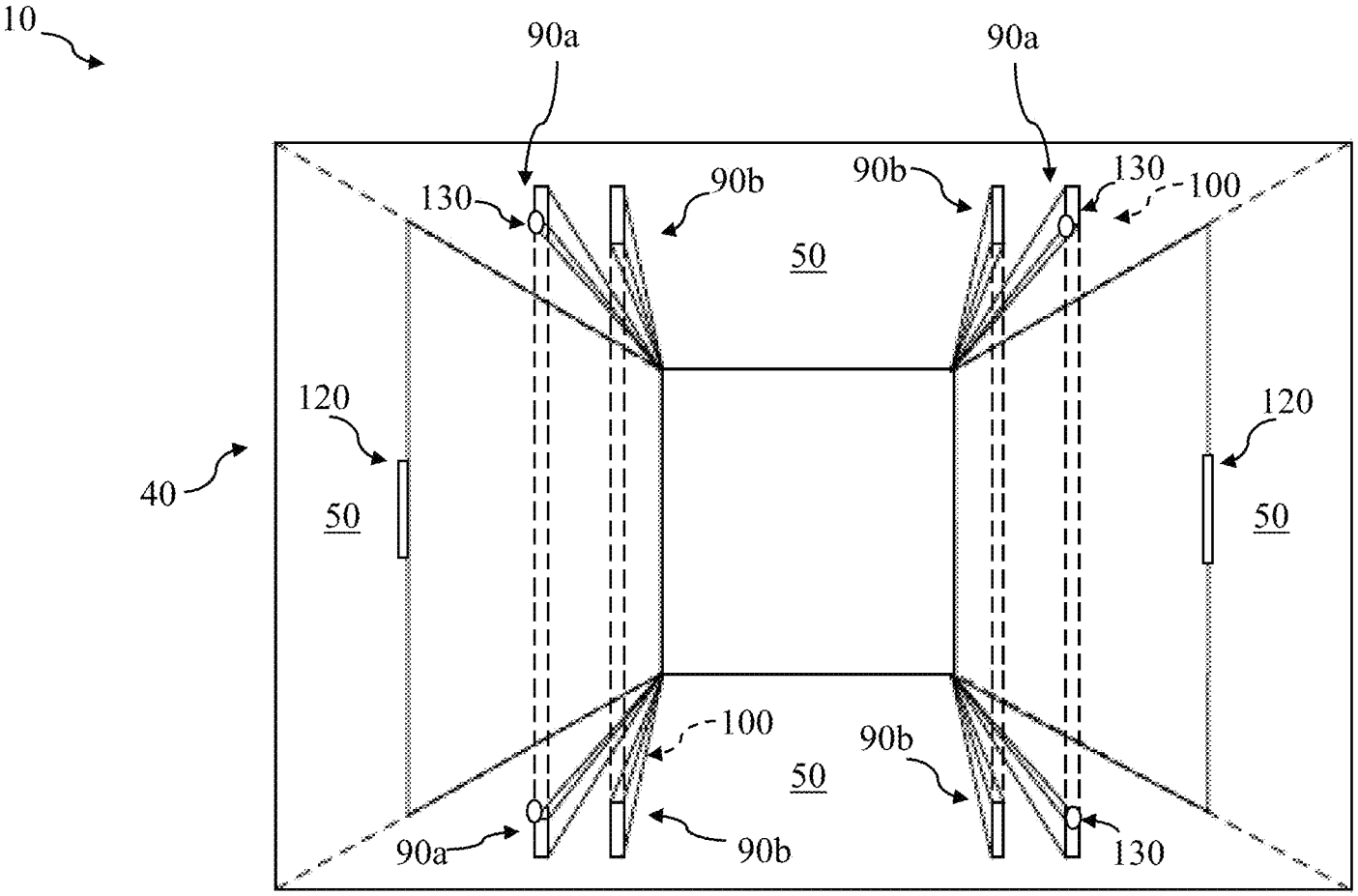
FIG. 7 shows a front view of a loudspeaker with a plurality of fins according to various implementations.
Figure 8:
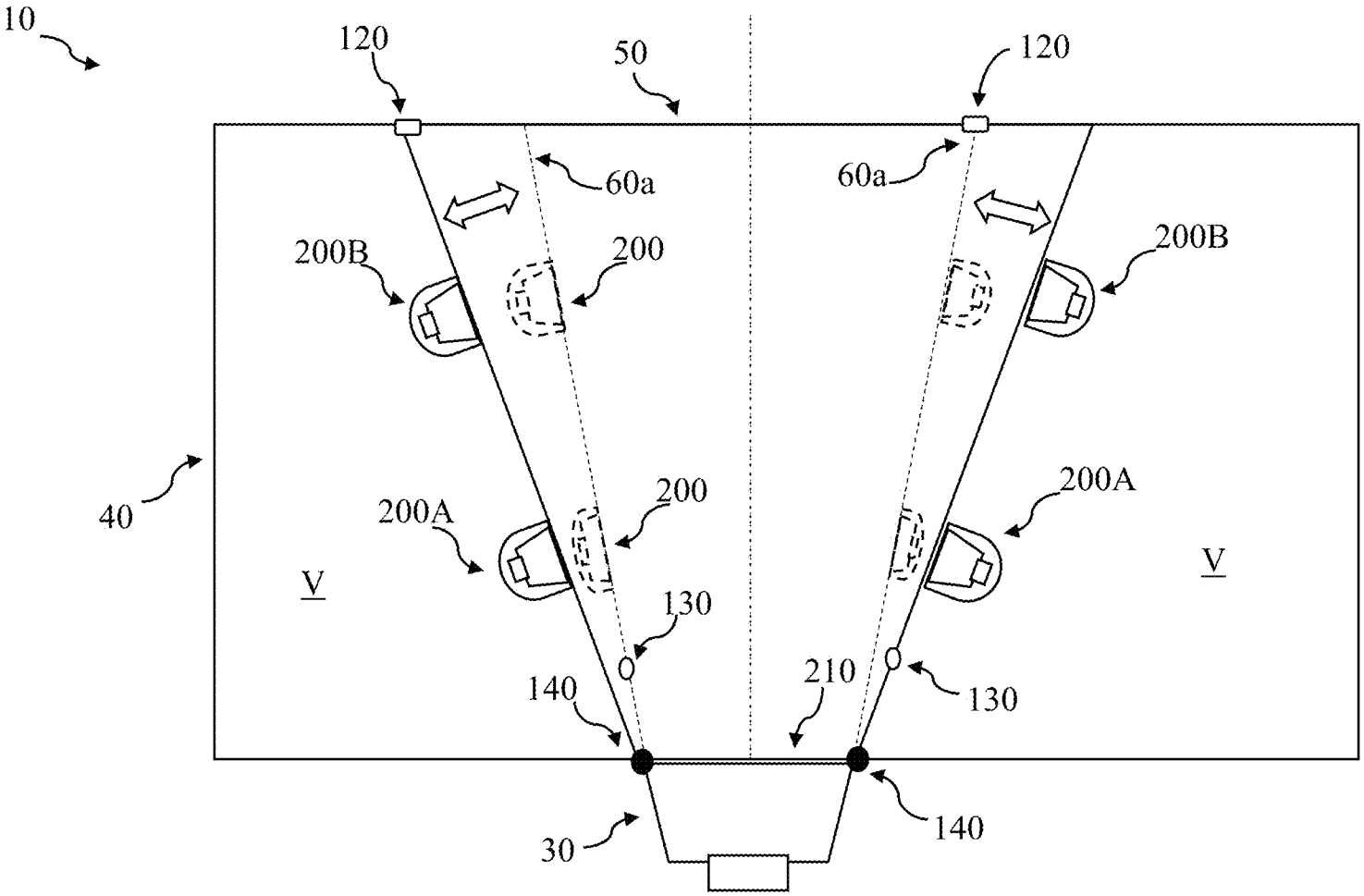
FIG. 8 shows a top view of a loudspeaker with drivers mounted in the waveguide according to various implementations.

FIG. 1 shows a side view of a loudspeaker 10, including an isolated view of portions of a waveguide 40 according to various implementations. FIG. 2 shows a front view of the loudspeaker 10 according to one particular implementation. FIG. 3 shows the loudspeaker configuration of FIG. 2, with the position of the waveguide 40 adjusted. FIG. 4 shows a front view of another implementation of the loudspeaker 10. FIGS. 5, 6 and 8 show top views, and FIG. 7 shows a front view, of variations on the loudspeaker 10 according to additional implementations. Several of these FIGURES are referred to simultaneously.

Referring to FIGS. 1-4, according to various implementations, the loudspeaker 10 includes a single speaker box 20 with at least one driver 30. In certain cases, the speaker box 20 includes a plurality of drivers (e.g., two, three, four or more drivers) 30, which in various implementations includes a line array of compression drivers. Three drivers 30 are illustrated in the example depiction in FIG. 1. In other cases, the speaker box 20 includes a single driver 30 that forms a point source (illustrated by two drivers 30 shown in phantom in FIG. 1). In any case, the driver(s) 30 can include one or more high frequency (HF) drivers (or, tweeters), low frequency (LF) drivers (or, woofers), and/or mid-range drivers.

The loudspeaker 10 can further include a waveguide 40 that is coupled with the speaker box 20. The waveguide 40 is configured to direct the acoustic output from the speaker box 20 to define a coverage pattern. According to various implementations, the waveguide 40 includes at least one pair of opposing walls 50 (FIGS. 2-4) that are fixed with respect to the driver 30.

The waveguide 40 further includes at least one adjustable wall 60 that is adjustable relative to the driver 30. A side view of an adjustable wall 60 is shown in FIG. 1. As described herein, the adjustable wall(s) 60 permit adjustment to the coverage pattern of the loudspeaker 10 for different use cases. That is, adjusting the wall(s) 60 modifies the coverage pattern from the driver 30 to the surrounding environment.

In particular implementations, as shown in FIGS. 1-3, the waveguide 40 includes a first pair of adjustable walls **60*a* that are aligned opposing one another. In particular cases, the first pair of adjustable walls 60*a* is aligned orthogonal to the pair of opposing walls 50 (FIG. 2) that are fixed with respect to the driver 30 (FIG. 1). In alternative implementations, as illustrated in FIG. 4, the waveguide 40 can include a distinct pair of adjustable walls 60*b* that are aligned opposing one another. As is visible when comparing FIGS. 3 and 4, the distinct pair of adjustable walls 60*b* are orthogonal to the first pair of adjustable walls 60*a*. In these implementations, the waveguide 40 includes only one pair of the adjustable walls 60*a* or 60*b*. In the case of the adjustable walls 60*b*, this distinct pair of adjustable walls 60*b* are aligned with the pair of opposing walls 50 that are fixed with respect to the driver 30, where one set of walls 50 are shown above and below the speaker box 20, respectively, in FIGS. 1-3**.

In certain implementations, the adjustable walls 60 are symmetrical relative to the speaker box 20. In these cases, adjustable walls 60 in each pair (e.g., **60*a* or 60*b*) are equally spaced from the driver 30. Additionally, each adjustable wall 60 can have the same length ($I_{AW}$) in these cases (FIG. 1), or in other cases, the length ($I_{AW}$) of adjustable walls 60 can vary. However, in other implementations, the adjustable walls 60 are asymmetric relative to the speaker box 20. In these cases, one of the adjustable walls 60 in a pair (e.g., 60***a* or 60*b*) is angled differently than another one of the adjustable walls in a pair (e.g., the other of 60*a* or 60*b*). In these cases, while the adjustable walls 60*a* or 60*b* have the same offset distance ($O_{AW}$), and length (law) (FIG. 1), the wall angle as compared between a first and second wall 60*a* or 60*b* in a pair is distinct.

In particular example implementations, as noted herein, where the adjustable wall 60 includes a plurality of adjustable walls (e.g., first pair 60*a* or distinct pair 60*b*), two or more walls 60 can be linked to move in unison. That, in various example implementations, the first pair of adjustable walls 60*a* is linked to move in unison, and in distinct implementations, the distinct pair of adjustable walls 60*b* is linked to move in unison. In certain cases, the adjustable walls 60 in each pair 60*a* or 60*b* are mechanically linked, e.g., with a mechanical system such as a belt, wheel and spoke mechanism, hydraulic system, etc. In other cases, the adjustable walls 60 are linked by an electro-mechanical system or a set of separately controlled electrical devices to control movement of two or more of the walls 60 in unison. In still further implementations, at least one of the adjustable walls 60 is configured to move independently of the other adjustable wall(s) 60.

In some implementations, shown in FIG. 1, at least one of the adjustable walls 60 is connected with electronics 65, including a motor 70 for adjusting a position of the wall(s) 60. One or more components in the electronics 65 can be coupled with other components in the loudspeaker 10 via wireless and/or hard-wired means, some connections of which are omitted for simplicity of illustration. In additional implementations, the motor 70 is connected with a controller 80 that comprises one or more processors for executing instructions to adjust the position of one or more walls 60. The controller 80 can also be configured to control audio output at the driver 30.

In additional implementations, the adjustable walls 60 can be manually adjusted, e.g., by a human user. In these implementations, the controller 80 can be configured to provide feedback (e.g., via a user interface (UI) 85 (FIG. 1) that can include a visual display and/or audio interface) to the human user about the position of the adjustable walls 60 as compared with a desired position (e.g., as described with respect to sensors herein) for a given coverage pattern. In various implementations, the controller 80 can provide feedback to the human user, via the UI 85, about the position of walls 60 in one or more loudspeakers 10, e.g., in an array of loudspeakers 10. In these cases, additional sensors are located on the loudspeaker(s) 10 and provide indicators to the controller 80 about placement of each loudspeaker 10 in an array of loudspeakers 10.

As shown in FIGS. 1-4 the loudspeaker 10 further includes at least one fin 90 coupled to the waveguide 40 for accommodating a gap 100 (FIG. 3, FIG. 4) between the pair of opposing walls 50 and the adjustable wall(s) 60. In various implementations, each fin 90 spans between one of the pair of opposing walls 50 and an adjustable wall 60. In particular cases, the fin(s) 90 are adjustable between two or more positions, for example, across a range of motion to accommodate (e.g., fill) the gap 100 between the pair of opposing walls 50 and the adjustable wall(s) 60. In certain cases, the speaker box 20 includes at least one mating feature 110 (FIGS. 1, 3 and 4) for retaining the fin(s) 90 in position to accommodate the gap 100. In certain cases, the mating feature(s) 110 can include mechanical linkages, couplings and/or interfaces for limiting movement of the fin(s) 90 relative to the opposing walls 50 and the adjustable wall(s) 60. For example, the mating feature(s) 110 can include male/female couplings such as a pin/slot coupling, male/female threading, snap-fit or press-fit coupling, etc. In particular cases, the mating feature(s) 110 include magnets. In still other cases, the mating feature(s) 110 include reusable adhesives.

In some implementations, as illustrated in FIGS. 2-4, the loudspeaker 10 further includes a set of retaining members 120 for selectively fixing the adjustable wall(s) 60*a* or 60*b* to the pair of opposing walls 50. For example, the set of retaining members 120 are shown selectively fixing the adjustable walls 60*a* in a first position in FIG. 2. FIG. 2 also illustrates (in phantom) the adjustable walls 60*a* in a second, narrower position. In the first position, the fin 90 is folded back behind the walls 60*a*, because the walls 60*a* are positioned in line with the fixed walls 50. In a second position, shown more clearly in FIG. 3 with adjustable walls 60*a*, and in FIG. 4 with adjustable walls 60*b*, the fin 90 substantially fills the gap 100 (illustrated in phantom) between the pair of opposing walls 50 and the adjustable wall(s) 60*a* or 60*b*. That is, the fin 90 completely fills, or nearly completely fills (minus any nominal gap between components) the gap 100 between the walls 50 and the adjustable wall(s) 60*a* or 60*b*. While described as being located in the first and second positions, the fin 90 can also remain fixed in a position according to various implementations. In these cases, the fin 90 is positioned to completely (or nearly completely) fill the gap 100 between the walls 50 and the adjustable wall(s) 60*a* or 60*b* when the adjustable wall(s) 60*a* or 60*b* are moved across a range of positions. In some implementations, the retaining members 120 can include any retaining and/or mating feature(s) described herein, for example, magnets or mating features such as the mating features 110 described with respect to fins 90.

In certain cases, the loudspeaker 10 further includes a sensor 130 located on the waveguide 40 and/or each fin 90. Several sensors 130 are illustrated in phantom in FIGS. 2-6. In various implementations, sensor(s) 130 are configured to detect the relative position of the waveguide 40 with respect to each fin 90. The sensor(s) 120 are connected with the controller 80 in various implementations (illustrated in FIG. 1). In particular cases, the sensor(s) 130 includes a reed switch and a magnet. For example, the reed switch can be located (e.g., mounted or otherwise affixed) on one of the walls 60 or the fin 90, while the magnet can be located (e.g., mounted or otherwise affixed) on the other one of the wall 60 or the fin 90. In other implementations, the sensor(s) 130 includes a Hall effect sensor and a magnet. For example, the Hall effect sensor can be located on one of the walls 60 or the fin 90, while the magnet can be located on the other one of the wall 60 or the fin 90. In still further implementations, the sensor(s) 130 includes an optical sensor located on the wall(s) 60 or the fin 90.

In certain implementations, the sensor(s) 130 provide feedback to the controller 80 about the position of the waveguide 40 (e.g., wall(s) 60) and the fins 90. In particular cases, the controller 80 is configured to adjust an acoustic parameter of the loudspeaker 10 in response to a detected change in the relative position of the waveguide 40 with respect to the fin 90. That is, the controller 80 is configured to adjust one or more acoustic parameters of the loudspeaker 10 based upon the detected position of the waveguide 40 with respect to the fin 90. In some examples, in response to detecting that the waveguide 40 has changed position with respect to the fin 90, the controller 80 is configured to adjust an equalization setting of the loudspeaker 10 (e.g., amplitude, phase and/or delay).

In particular implementations, as noted herein, the loudspeaker 10 is one of an array of loudspeakers. In these cases, the controller 80 is configured to communicate with controllers in other loudspeakers in the array and/or a central controller for adjusting the positions of the waveguide(s) 40 and fin(s) 90. In various implementations, the controllers 80 in loudspeakers 10 within an array are configured to communicate with one another and/or a central controller to assign waveguide angles for each of the loudspeakers 10.

As noted herein, the adjustable walls 60 can be adjustable between a plurality of positions to modify the radiation pattern of the loudspeaker 10. In particular implementations each adjustable wall 60 is connected with the speaker box 20 at a primary hinge 140 (FIGS. 2-8). In these cases, each adjustable wall 60 is adjustable by pivoting about the primary hinge 140.

In still further implementations, as illustrated in the examples in FIGS. 5 and 6, the adjustable wall 60*a* includes a secondary (or, internal) hinge 150 that separates a primary segment 160 and a secondary segment 170. In these cases, the primary segment 160 is positioned to pivot about the primary hinge 140, and the secondary segment 170 is positioned to pivot about the secondary hinge 150. In certain implementations, the secondary segment 170 mitigates acoustic energy spillover into a volume (V) behind the adjustable wall(s) 60.

Turning to FIG. 6, in particular cases, a portion of each adjustable wall 60 is configured to fold back over itself, e.g., for storage purposes and/or to accommodate different positions for different radiation patterns. In certain implementations, such as where the adjustable wall 60 includes the secondary (internal) hinge 150 for at least partially folding the secondary segment 170 back over the primary segment 150, the loudspeaker 10 can include a housing 180 including a pocket 190 for receiving the adjustable wall 60 when the secondary segment 170 is folded back over the primary segment 160, about the secondary hinge 150. That is, the housing 180 is configured to store at least a portion of the adjustable wall 60 when the secondary segment 170 is folded back over the primary segment 160.

It is understood that each adjustable wall 60 can include any number of hinges and segments, e.g., three, four, five, etc. hinge/segment combinations to accommodate various positions and radiation patterns for the loudspeaker 10. These additional hinges and segments can be configured to adjust the radiation pattern of the loudspeaker 10, and can be stored in a manner similar to the primary segment 160 and secondary segment 170 described with respect to the adjustable wall(s) 60*a* or 60*b*, e.g., in a pocket.

In still further implementations (not shown), walls 50 can include a secondary segment (e.g., similar to secondary segment 170) that is configured to pivot about a hinge (e.g., similar to secondary hinge 150) to adjust the radiation pattern of the loudspeaker 10. These implementations can be combined with any implementation of adjustable wall(s) 60*a*, 60*b* described herein.

In certain example implementations, as shown in FIG. 7, the loudspeaker 10 includes a plurality of fins 90*a*, 90*b*, etc., for accommodating movement of the adjustable wall(s) 60 across a range of positions. Only two distinct fin configurations are shown for clarity of illustration, but it is understood that several (or more) fin configurations can be incorporated in the loudspeaker 10 according to various implementations. Each of the fins 90 corresponds to different angular position of the adjustable wall 60 relative to the at least one driver 30. In these cases, each of the fins 90*a*, 90*b*, etc. has a different height for accommodating a different gap depending on the angular orientation of the wall relative to the at least one driver 30. In some example implementations, the fins 90*a*, 90*b*, etc. have different shapes, e.g., such that fins 90*a*, 90*b*, etc. rise progressively in height to form more trapezoidal shapes for filling the gap 100 between the walls 50 and the adjustable wall(s) 60. In certain implementations, the distinct fins 90*a*, 90*b*, etc. are located at different positions on the waveguide 40. As noted herein, in some cases, the fins 90*a*, 90*b*, etc. are fixed in position, and in other cases, the fins 90*a*, 90*b*, etc. are mounted on one or more hinges. Where fins 90*a*, 90*b*, etc. are fixed in position, additional setup and adjustment time can be avoided as compared with embodiments where the fins 90*a*, 90*b*, etc. are mounted on hinges.

In still further implementations, for example as shown in FIG. 8, a waveguide 40 can further include a set of drivers 200 located on one or more adjustable walls 60. In certain aspects, the adjustable walls 60 define a fixed volume (V) behind each driver 200. In cases where the loudspeaker 10 includes a pair of opposing adjustable walls 60*a*, for example as illustrated in FIG. 8, a first of drivers 200A is located closer to a throat region 210 of the loudspeaker 10 than a second pair of drivers 200B. In these cases, the loudspeaker 10 includes a plurality of pairs of wall-mounted drivers 200, e.g., two or more drivers 200 mounted on each of the adjustable walls 60*a*. In additional examples, several drivers 200 can be mounted along each of the adjustable walls 60*a*, e.g., at different distances from the throat region 210.

According to some implementations, drivers 200 at different locations relative to the throat region 210 are tuned to distinct frequencies. For example, the first set of drivers 200A that is closer to the throat region 210 can be tuned to a higher frequency than the second set of drivers 200B that are located farther from the throat region 210. In some example implementations, the waveguide 40 is sufficiently small so as not to load (e.g., acoustically couple) the drivers 200. In certain implementations, each driver in a given set of drivers (e.g., drivers 200A in a first set, drivers 200B in a second set, etc.) is tuned to the same frequency. In these cases, drivers 200 from distinct sets (e.g., drivers 200A in first set, drivers 200B in second set) are tuned to distinct frequencies. In various implementations, the radiation pattern of the loudspeaker 10 is adjustable based on the position of the adjustable walls 60*a* or 60*b* (as noted herein). The radiation pattern of the loudspeaker 10 can also depend upon the spacing between drivers 200 in each set, e.g., the distance between drivers 200A in the first set and the distance between drivers 200B in the second set as measured in a line extending perpendicular to the firing direction of the driver 30 in the speaker box 20. This distance between drivers 200 within the same set is adjustable by modifying the position of the adjustable walls 60*a* or 60*b* on which the drivers 200 are mounted. In terms or relative spacing, drivers 200 in the same set that are positioned closer together will contribute to a wider radiation pattern, while positioning those drivers 200 farther apart will contribute to a narrower radiation pattern. In various implementations, the user or the controller 80 is configured to select the pair(s) of drivers 200 that provide the desired coverage pattern for the loudspeaker 10 based on the known waveguide coverage angle.

In still further implementations, the loudspeaker 10 is configured to operate in a plurality of operating modes. In the example depicted in FIG. 8, having two distinct sets of drivers 200A, 200B at different locations along the adjustable walls 60*a* or 60*b*, the loudspeaker 10 is configured to operate in at least two distinct operating modes. In this case, in a first operating mode, the first set of drivers 200A is driven, and in a second operating mode, the second set of drivers 200B is driven. In the first operating mode, the pair of opposing adjustable walls 60*a* or 60*b* are positioned at a first angle with respect to the driver 30 in the speaker box 20 (FIG. 1) (e.g., with respect to the center line of the driver 30), and in the second operating mode, the pair of opposing adjustable walls 60*a* or 60*b* are positioned at a second, narrower angle with respect to the center line of the driver 30 in the speaker box 20 (FIG. 1).

As noted herein, the adjustable walls 60 and components therein can be controlled using a controller 80, and in some cases, can be repositioned using the motor 70 (e.g., an electro-magnetic motor). In various implementations, the motor 70 is coupled with one or more control circuits (e.g., in the controller 80, FIG. 1) for providing electrical signals to adjust the position of the walls 60. The control circuit(s), where applicable, can include a processor and/or microcontroller, which in turn can include electro-mechanical control hardware/software, and decoders, DSP hardware/software, etc. for playing back (rendering) audio content at the loudspeaker 10. The control circuit(s) can also include one or more digital-to-analog (D/A) converters for converting the digital audio signal to an analog audio signal. This audio hardware can also include one or more amplifiers which provide amplified analog audio signals to the loudspeaker 10. In additional implementations, the control circuit(s) include sensor data processing logic for processing data from sensors 130, e.g., to control adjustment of the adjustable walls 60 and/or the fins 90. In certain additional cases, as noted herein, the controller 80 can be configured to display or otherwise indicate the waveguide angle(s) 40 for each loudspeaker 10, e.g., at the UI 85.

In operation, the control circuit(s) in loudspeaker 10 are configured to convert an electrical signal to an acoustic output at the drivers, e.g., drivers 30 in the speaker box 20 and/or drivers 200 in the adjustable walls 60. As noted herein, the adjustable walls 60 and corresponding fins 90 allow for adjustment to the radiation pattern of the loudspeaker 10 according to desired use cases. In contrast to conventional loudspeakers, loudspeaker 10 provides an adaptable, reliable and cost-effective speaker configuration that can be particularly useful in traveling (or, touring) and/or rental cases. In particular examples, the loudspeaker 10 can be used to adapt a physical space for different purposes, e.g., for different events at the same venue, where seating arrangements are adjusted and/or stage location is modified.

One or more components in the loudspeaker 10 can be formed of any conventional loudspeaker material, e.g., a heavy plastic, metal (e.g., aluminum, or alloys such as alloys of aluminum), composite material, etc. It is understood that the relative proportions, sizes and shapes of the loudspeaker 10 and components and features thereof as shown in the FIGURES included herein can be merely illustrative of such physical attributes of these components. That is, these proportions, shapes and sizes can be modified according to various implementations to fit a variety of products. For example, while a substantially circular-shaped loudspeaker may be shown according to particular implementations, it is understood that the loudspeaker could also take on other three-dimensional shapes in order to provide acoustic functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

I claim:

1. A loudspeaker comprising:

a single speaker box with at least one driver;

a waveguide having:

a pair of opposing walls that are fixed with respect to the at least one driver; and at least one adjustable wall that is adjustable relative to the at least one driver; and at least one fin coupled to the waveguide for accommodating a gap between the pair of opposing walls and the at least one adjustable wall.

2. The loudspeaker of claim 1, wherein the at least one adjustable wall comprises a pair of adjustable walls aligned opposing one another.

3. The loudspeaker of claim 2, wherein the pair of adjustable walls is either aligned with the pair of opposing walls or orthogonal to the pair of opposing walls.

4. The loudspeaker of claim 1, wherein the at least one adjustable wall comprises a plurality of adjustable walls linked to move in unison.

5. The loudspeaker of claim 1, wherein adjusting the at least one wall modifies a coverage pattern of the loudspeaker.

6. The loudspeaker of claim 1, wherein the at least one adjustable wall is connected with the speaker box at a primary hinge and is adjustable by pivoting about the primary hinge.

7. The loudspeaker of claim 6, wherein the at least one adjustable wall comprises a secondary hinge separating a primary segment that is positioned to pivot about the primary hinge, and a secondary segment that is positioned to pivot about the secondary hinge.

8. The loudspeaker of claim 7, further comprising a housing comprising a pocket for receiving the at least one adjustable wall when the secondary segment is folded back over the primary segment about the secondary hinge.

9. The loudspeaker of claim 7, wherein the secondary segment mitigates acoustic energy spillover into a volume behind the at least one adjustable wall.

10. The loudspeaker of claim 1, wherein the at least one fin spans between one of the pair of opposing walls and the at least one adjustable wall.

11. The loudspeaker of claim 1, wherein the speaker box comprises at least one mating feature for retaining the at least one fin in position to accommodate the gap between the pair of opposing walls and the at least one adjustable wall.

12. The loudspeaker of claim 1, wherein the at least one driver comprises a line array of compression drivers or a point source.

13. The loudspeaker of claim 1, further comprising:

a sensor located on the waveguide or each fin, the sensor configured to detect a relative position of the waveguide with respect each fin; and a controller coupled with the sensor and the at least one driver, wherein the controller is configured to adjust an acoustic parameter of the loudspeaker in response to a detected change in the relative position of the waveguide with respect to the fin.

14. The loudspeaker of claim 1, further comprising a set of retaining members for selectively fixing the at least one adjustable wall to the pair of opposing walls in a first position, and selectively fixing the at least one fin to the at least one adjustable wall in a second position, wherein in the second position, the at least one fin substantially fills the gap between the pair of opposing walls and the at least one adjustable wall.

15. The loudspeaker of claim 1, wherein the waveguide further comprises a set of drivers located on the at least one adjustable wall.

16. The loudspeaker of claim 15, wherein the at least one adjustable wall comprises a pair of opposing adjustable walls, and wherein the set of drivers comprises a first set of drivers closer to a throat of the loudspeaker than a second set of drivers.

17. The loudspeaker of claim 16, wherein the pair of opposing adjustable walls define a fixed volume behind each of the set of drivers, wherein the first set of drivers are tuned to a higher frequency than the second set of drivers.

18. The loudspeaker of claim 16, wherein in a first operating mode the first set of drivers is driven, and in a second operating mode the second set of drivers is driven, wherein in the first operating mode the pair of opposing adjustable walls are positioned at a first angle with respect to the at least one driver, and in the second operating mode the pair of opposing adjustable walls are positioned at a second, narrower angle with respect to the at least one driver.

19. The loudspeaker of claim 1, further comprising a motor coupled with the at least one adjustable wall for adjusting a position of the at least one adjustable wall.

20. The loudspeaker of claim 1, wherein the at least one fin comprises a plurality of fins, each fin of the plurality corresponding to a different angular position of the adjustable wall relative to the at least one driver, wherein the each of the fins of the plurality of fins has a different height for accommodating a different gap depending on the angular orientation of the wall relative to the at least one driver.

* * * * *